United States Patent [19]

Amon et al.

[11] 4,287,234

[45] Sep. 1, 1981

[54] DESENSITIZING INK FOR THE RECEIVING SURFACE OF A CHEMICAL DUPLICATING SET BY WET OFFSET PRINTING

[75] Inventors: Albert Amon; Roger Weil, both of Lausanne; Paul Heinzer, Pully, all of Switzerland

[73] Assignee: Sipca Holding S.A., Glarus, Switzerland

[21] Appl. No.: 82,749

[22] Filed: Oct. 9, 1979

Related U.S. Application Data

[63] Continuation of Ser. No. 885,218, Mar. 10, 1978, abandoned.

[30] Foreign Application Priority Data

Jan. 25, 1978 [CH] Switzerland ..... 771/78

[51] Int. Cl.[3] ..... B41M 3/12

[52] U.S. Cl. ..... 427/150; 101/135; 260/18 R; 260/DIG. 38; 282/27.5; 427/151; 525/472; 525/488; 525/507; 525/508

[58] Field of Search ..... 282/27.5; 427/150, 151; 106/20, 21, 30; 260/DIG. 38; 101/135, 450

[56] References Cited

U.S. PATENT DOCUMENTS

| | | | |
|---|---|---|---|
| 3,029,216 | 4/1962 | Bailey et al. | 260/823 |
| 3,246,997 | 4/1966 | Summer et al. | 106/22 |
| 3,477,862 | 11/1969 | Forsyth, Jr. | 106/22 |
| 3,692,548 | 9/1972 | Packer | 106/22 |
| 3,952,117 | 4/1976 | Miyamoto | 427/150 |

FOREIGN PATENT DOCUMENTS

| | | | |
|---|---|---|---|
| 47-38201 | 9/1972 | Japan | 106/20 |
| 1433469 | 2/1976 | United Kingdom | 106/20 |

*Primary Examiner*—J. Ziegler

[57] ABSTRACT

A desensitizing ink for wet offset printing on the acceptor surface of a chemical duplicating set of superimposed sheets where one of the sets has an electrophilic acceptor coating and the other a nucleophilic coating for producing a chromogenic reaction wherein the nucleophilic desensitizing ink contains an alkoxylated nucleophilic compound which permits a continuous ink transfer to the water repellant zones of the wetted impression plate of an offset press and simultaneously neutralizes the corresponding zones of the acceptor surface.

7 Claims, No Drawings

DESENSITIZING INK FOR THE RECEIVING SURFACE OF A CHEMICAL DUPLICATING SET BY WET OFFSET PRINTING

This is a continuation of copending, application Ser. No. 885,218, filed Mar. 10, 1978, now abandoned.

There are currently available on the market duplicating units which comprise a first sheet, the back of which is covered with microcapsules of a nucleophilic leuco-derivative and at least one second sheet underlying the first sheet and having on its front side an electrophilic acceptor layer. Writing with a ball-point pen or a typewriter on the front side of the first sheet of the duplicating set is reproduced on the second sheet by reaction of the nucleophilic leuco-derivative with the electrophilic acceptor, due to the breaking of the microcapsules upon the writing or typing.

In the event that it is desired that such a chemical reaction not take place in certain zones of the second sheet, the electrophilic acceptor can be desensitized by overprinting a nucleophilic film selected from the group consisting of cationic salts of quaternary ammonium or amines and diamines of high molecular weight, for instance.

This overprinting can be effected by the customary printing processes such as typography or flexography, for instance. The above-mentioned nucleophilic inks, however, do not lend themselves to wet offset printing, due to the fact that they are of too hydrophilic a character.

The object of the present invention is a desensitizing ink for wet offset printing on an acceptor surface of a chemical duplicating set comprising at least two superimposed sheets, one of the facing surfaces of which has an electrophilic acceptor coating and the other a nucleophilic coating capable of producing a chromogenic reaction with the said electrophilic acceptor coating.

Said ink is characterized by the fact that it comprises an alkoxylated nucleophilic compound so as to permit, on the one hand, a continuous transfer of the ink from the inking rollers to the water-repellent zones of the wetted impression plate of an offset press and, on the other hand, to neutralize corresponding zones of the acceptor surface of the duplicating set and thus prevent any colored formation in the said zones upon subsequent writing or typing on the said duplicating set.

The electrophilic coatings currently used for the formation of an acceptor surface may comprise absorbent mineral fillers of the attapulgite, zeolite, kaolin, or pyrophyllite type, etc., acting as acceptors of the benzoyl leuco derivative of methylene blue or of the lactone crystal violet which the coating on the facing surface of the other sheet of the duplicating set may contain.

Phenols and phenolic resins as well as derivatives of salicylic acid and zinc salts of such derivatives are also used as active components of electrophilic coatings of the acceptor surfaces of such duplicating sets.

The desensitizing ink in accordance with the present invention for wet offset printing on such acceptor surfaces may be formulated, for instance, in the following manner:

EXAMPLE 1

A varnish is prepared containing 65% by weight of ethoxylated octylphenol, 30% by weight of rosin esterified with glycerol, and 5% by weight of mineral oil.

Into 84 parts by weight of this varnish there are incorporated four parts by weight of micronized silica and 12 parts by weight of calcium carbonate.

There is thus obtained a transparent ink which can be easily transferred onto the water repellent zones of the impression plate of a wet offset press, the ethoxylated octylphenol of which constitutes the neutralizing agent of the electrophilic coating of the acceptor surface to be desensitized.

EXAMPLE 2

In order to obtain a covering desensitizing ink in accordance with the invention, a varnish is prepared containing 67% by weight ethoxylated nonylphenol and 33% by weight of resin esterified with glycerol.

In 73 parts by weight of this varnish there are incorporated 2 parts by weight of micronized silica, 10 parts by weight of calcium carbonate, and 15 parts by weight of titanium white (rutile).

EXAMPLE 3

A varnish is prepared containing 66% by weight of a block copolymer of propylene oxide and ethylene oxide and 36% by weight of phenolic resin modified with maleic anhydride (acid number: 135–145).

In 85 parts by weight of this varnish there are incorporated 4 parts by weight of micronized silica and 11 parts by weight of calcium carbonate.

EXAMPLE 4

A varnish is prepared containing 69% by weight, polypropylene glycol and 31% by weight of phenolic resin, modified with maleic anhydride (acid number: 135–145).

In 86 parts by weight of this varnish there are incorporated 4 parts by weight of micronized silica and 10 parts by weight of calcium carbonate.

The formulations of Examples 3 and 4 make it possible to obtain a transparent desensitizing ink intended to be printed on an acceptor surface of the aforementioned type by wet offset printing of the zones of the latter to be neutralized.

Numerous other alkoxylated nucleophilic components may also be used for the formulating of desensitizing inks in accordance with the invention. These components may in particular be selected from among the polyoxyethylenated acids and their salts (stearates, mixture of resin and fatty acids), polyoxyethylene alcohols (lauric, cetyl, stearic, oleic, tridecylic alcohols and their mixtures), the polyoxyethylenated sorbitol esters (oleate, tallow, beeswax, mixture of resinic acid and fatty acid), the polyoxyethylenated esters of sorbitan and fatty acids (laurate, palmitate, stearate, oleate, and their mixtures).

In order to determine the degree of alkoxylation of the nucleophilic compounds which is most favorable in order to permit the continuous transfer of the ink in which they are incorporated from the inking rollers onto the water-repellent zones of the wetted impression plate of an offset press, recourse may be had to the HLB scale of industrial emulsifiers (Hydrophile-Lipophile Balance) developed by Atlas Chemical Industries Inc. (see also Morgan P. W. "Determination of Ethers and Esters of Ethylene Glycol", Ind. and Eng. Chem. Anal. E. Vol. 18, page 500, 1946).

It has been found that the degree of alkoxylation which permits the aforementioned transfer of ink onto the water-repellent zones of a wetted offset impression plate corresponds to a hydrophile-lipophile balance which is between the values of 2 and 9 and preferable the values 3 and 4 on the aforementioned HLB scale.

What is claimed is:

1. A process of desensitizing an acceptor surface of a chemical duplicating set having at least two superimposed sheets one of the facing surfaces of which has an electrophillic acceptor coating and the other a nucleophilic coating capable of producing a chromogenic reaction with the electrophillic acceptor coating, said process comprising printing in wet offset on said acceptor surface an ink coating comprising an alkoxylated nucleophilic compound wherein said compound is alkoxylated to a degree such that the hydrophile-lipophile balance of said ink is from 2 to 9 so as to permit both the continuous transfer of the ink from the inking rollers to the water repellant zones of the wetted impression plate of an offset press and simultaneously the neutralization of the corresponding zones of the acceptor surface of the duplicating set, thus prevent any colored formation in the said zones upon subsequent writing or typing on the said duplicating set.

2. The process of claim 1, wherein said nucleophilic coating comprises an alkoxylated nucleophilic compound selected from the group consisting of ethoxylated octylphenol, ethoxylated nonylphenol, a block copolymer of propylene oxide and ethylene oxide and polypropylene glycol.

3. The process of claim 1, wherein said nucleophilic compound comprises ethoxylated octylphenol.

4. The process of claim 1, wherein said nucleophilic compound comprises ethoxylated nonylphenol.

5. The process of claim 1, wherein said nucleophilic compound comprises a block copolymer of propylene oxide and ethylene oxide.

6. The process of claim 1, wherein said hydrophile-lipophile balance is from 3 to 4.

7. The process of claim 1, wherein said nucleophilic compound comprises polypropylene glycol.

* * * * *